US012215906B2

(12) United States Patent
Kawano et al.

(10) Patent No.: US 12,215,906 B2
(45) Date of Patent: Feb. 4, 2025

(54) HEAT PUMP SYSTEM AND METHOD FOR CONTROLLING THE SAME

(71) Applicants: DAIKIN INDUSTRIES, LTD., Osaka (JP); DAIKIN EUROPE N.V., Ostend (BE)

(72) Inventors: Satoshi Kawano, Osaka (JP); Kevin Cornelis, Ostend (BE); Martijn Deprez, Ostend (BE)

(73) Assignees: DAIKIN INDUSTRIES, LTD., Osaka (JP); DAIKIN EUROPE N.V., Ostend (BE)

( * ) Notice: Subject to any disclaimer, the term of this patent is extended or adjusted under 35 U.S.C. 154(b) by 390 days.

(21) Appl. No.: 17/790,618

(22) PCT Filed: Mar. 5, 2021

(86) PCT No.: PCT/JP2021/008586
§ 371 (c)(1),
(2) Date: Jul. 1, 2022

(87) PCT Pub. No.: WO2021/177429
PCT Pub. Date: Sep. 10, 2021

(65) Prior Publication Data

US 2023/0042444 A1 Feb. 9, 2023

(30) Foreign Application Priority Data

Mar. 6, 2020 (EP) ..... 20161356

(51) Int. Cl.
*F25B 49/02* (2006.01)
*F25B 13/00* (2006.01)
*F25B 41/20* (2021.01)

(52) U.S. Cl.
CPC ..... *F25B 49/02* (2013.01); *F25B 13/00* (2013.01); *F25B 41/20* (2021.01)

(58) Field of Classification Search
CPC .. F25B 13/00; F25B 2600/2513; F25B 41/31; F25B 2700/1931; F25B 2313/029; F25B 2700/21152; F24F 11/84
See application file for complete search history.

(56) References Cited

U.S. PATENT DOCUMENTS 4,644,756 A * 2/1987 Sugimoto ..... F24F 1/0071 62/200
5,369,958 A * 12/1994 Kasai ..... F25B 13/00 62/196.3

(Continued)

FOREIGN PATENT DOCUMENTS

EP 2 320 159 A1 5/2011
EP 2 434 233 A2 3/2012

(Continued)

OTHER PUBLICATIONS

International Preliminary Report on Patentability and Written Opinion of the International Searching Authority for International Application No. PCT/JP2021/008586, dated Sep. 15, 2022.

(Continued)

*Primary Examiner* — Nelson J Nieves
*Assistant Examiner* — Meraj A Shaikh
(74) *Attorney, Agent, or Firm* — Birch, Stewart, Kolasch & Birch, LLP

(57) ABSTRACT

A heat pump system includes a first bypass pipe provided with a first bypass valve and connecting a liquid refrigerant pipe and a low-pressure refrigerant pipe, a refrigerant heat exchanger configured to cause a heat-exchange between refrigerant flowing in the liquid refrigerant pipe and refrigerant flowing in first bypass pipe, a second bypass pipe provided with a second bypass valve and connecting the liquid refrigerant pipe and the low-pressure refrigerant pipe, and a controller. The controller is configured to control opening degree of the first bypass valve based on detected (Continued)

superheated temperature of refrigerant flowing in the first bypass pipe, and detected discharge temperature of a compressor and control opening degree of the second bypass valve based on the detected discharge temperature.

20 Claims, 7 Drawing Sheets

(56) References Cited

U.S. PATENT DOCUMENTS

| | | | | |
|---|---|---|---|---|
| 8,539,785 | B2 * | 9/2013 | Jiang | F25B 49/027 62/217 |
| 9,803,897 | B2 * | 10/2017 | Furui | F25B 30/02 |
| 11,662,125 | B2 * | 5/2023 | Xie | F25B 41/48 62/244 |
| 2003/0010046 | A1 | 1/2003 | Freund et al. | |
| 2015/0338121 | A1 | 11/2015 | Yamashita | |
| 2019/0338986 | A1 | 11/2019 | Yamada et al. | |

FOREIGN PATENT DOCUMENTS

| | | | |
|---|---|---|---|
| EP | 2878901 | A1 | 6/2015 |
| JP | 2009-229055 | A | 10/2009 |
| JP | 2010-54186 | A | 3/2010 |
| JP | 2012-67967 | A | 4/2012 |
| JP | 2013-15264 | A | 1/2013 |
| JP | 2014-119220 | A | 6/2014 |
| WO | WO 2018/062177 | A1 | 4/2018 |

OTHER PUBLICATIONS

International Search Report, issued in PCT/JP2021/008586, PCT/ISA/210, dated Jun. 8, 2021.

Search Report issued in European priority application 20161356.9, dated Sep. 16, 2020.

Written Opinion of the International Searching Authority, issued in PCT/JP2021/008586, PCT/ISA/237, dated Jun. 8, 2021.

* cited by examiner

[Fig. 1]
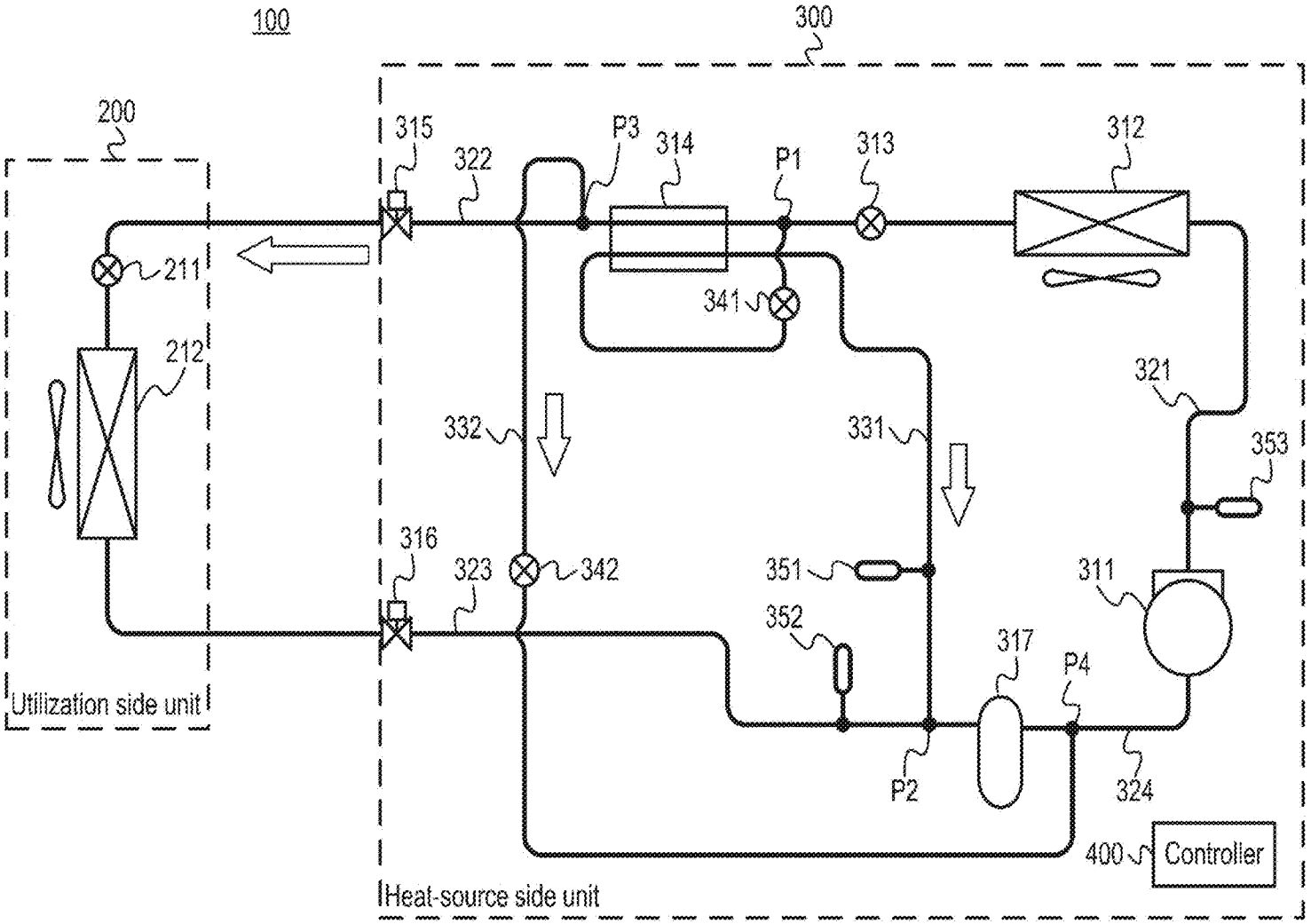

[Fig. 2]
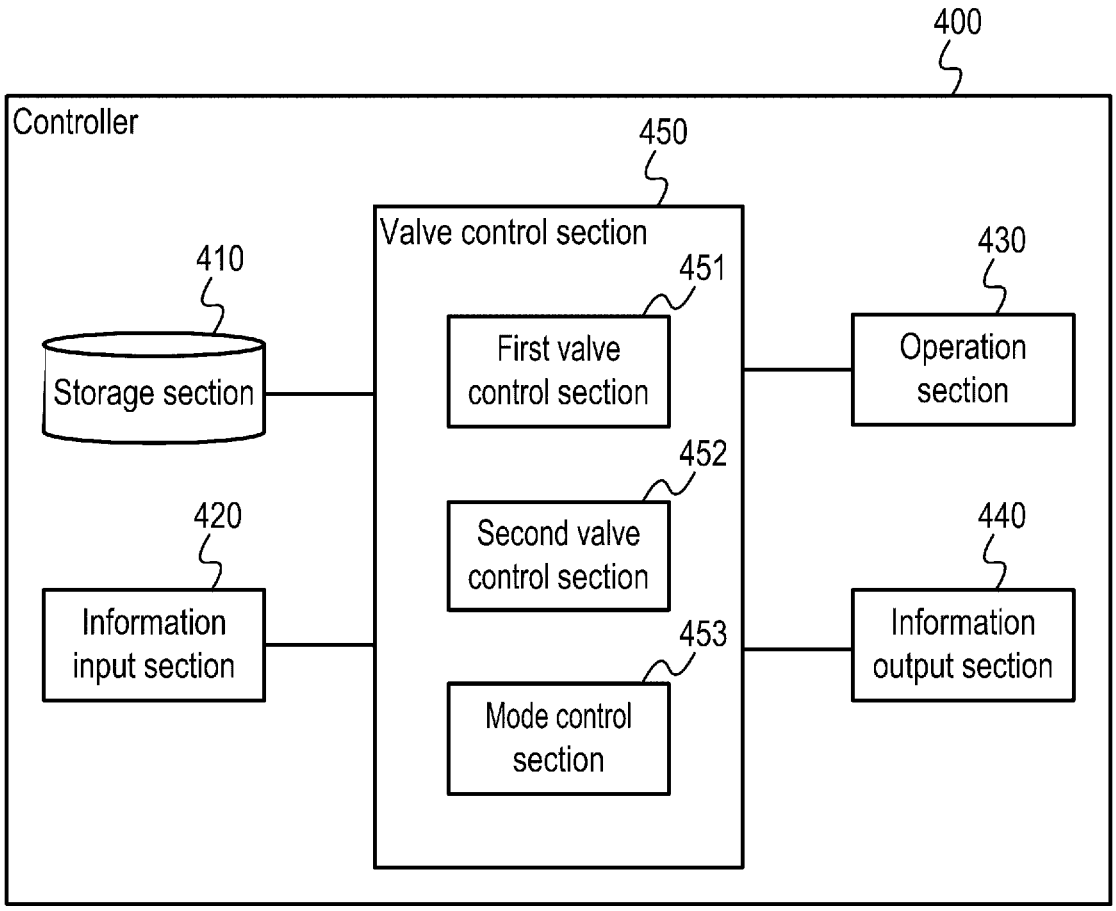

[Fig. 3]
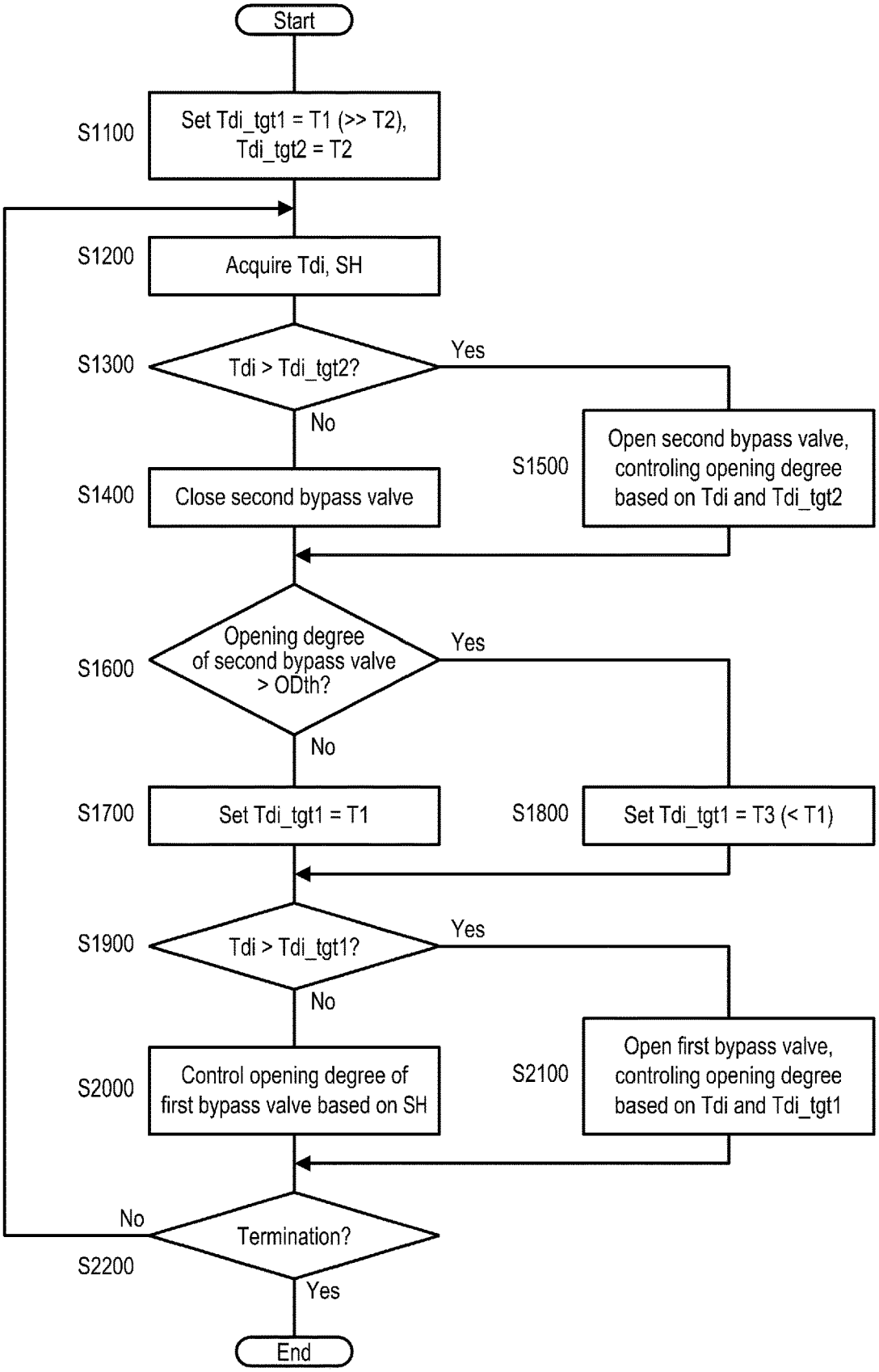

[Fig. 4]
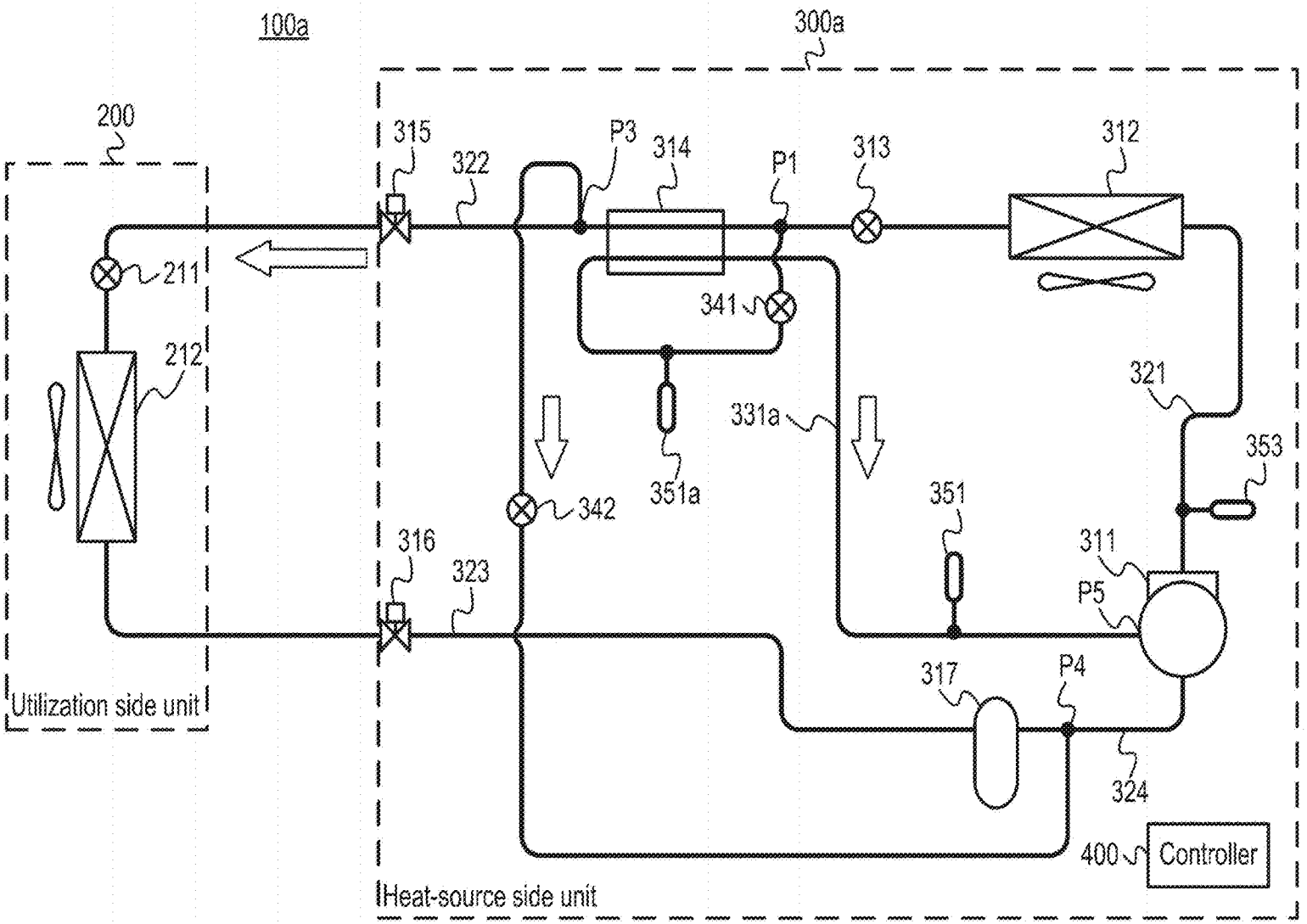

[Fig. 5]
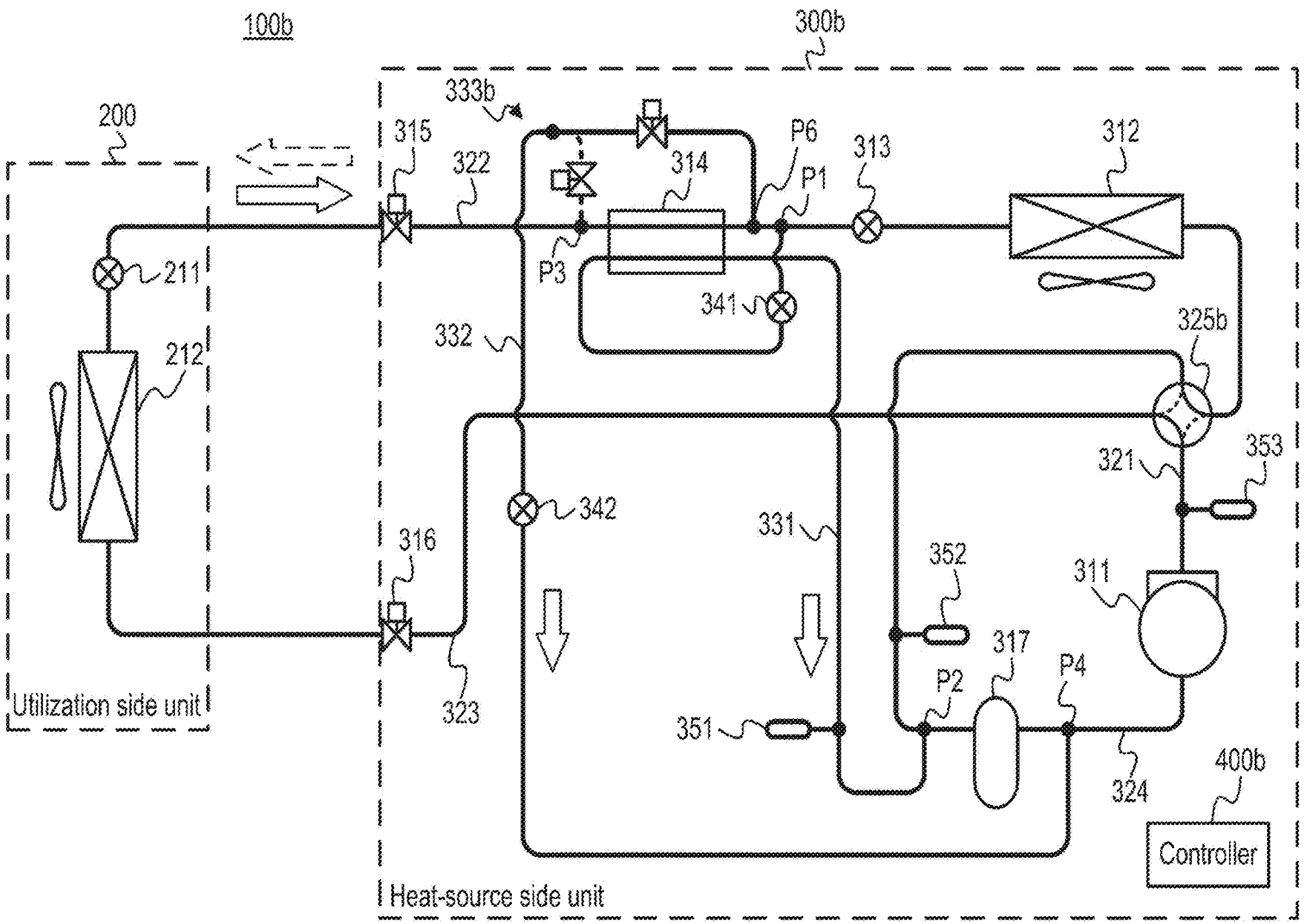

[Fig. 6]
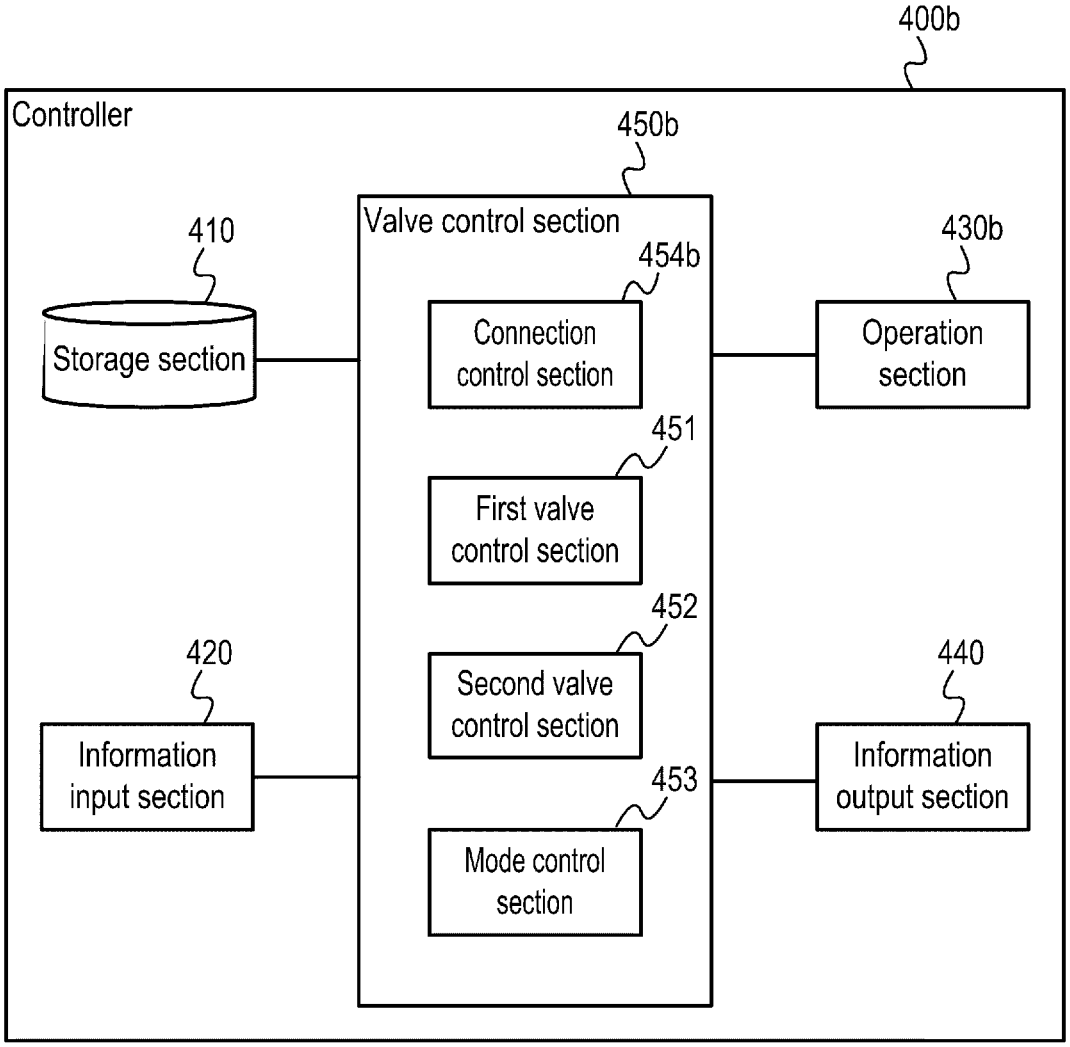

[Fig. 7]
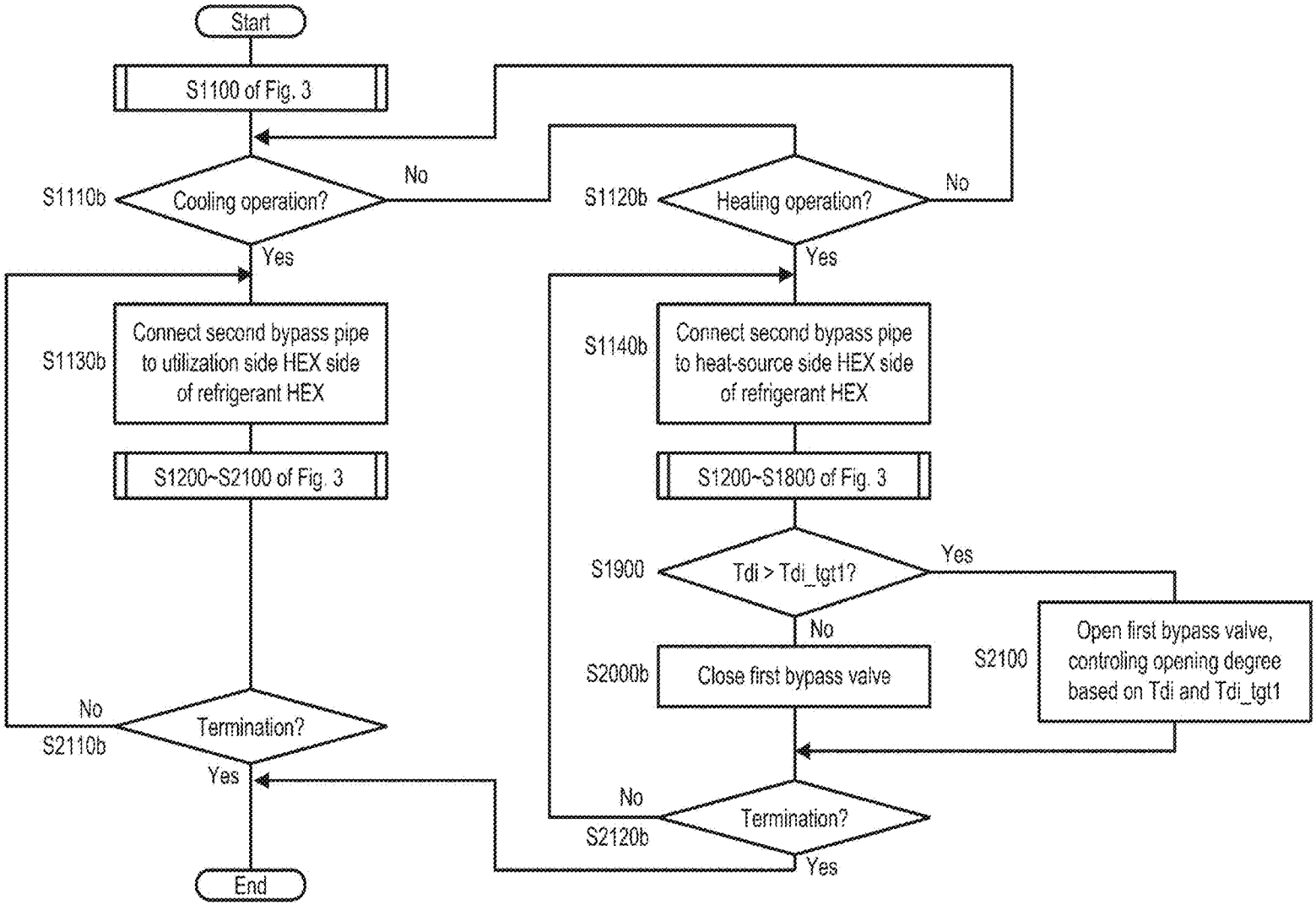

HEAT PUMP SYSTEM AND METHOD FOR CONTROLLING THE SAME

TECHNICAL FIELD

The present invention relates to a heat pump system and a method for controlling the heat pump system.

BACKGROUND ART

WO 2018/062177 A1 proposes a heat pump system having a subcooling system and an injection system. The subcooling system includes a first bypass pipe, a refrigerant heat exchanger, and a first bypass valve. The injection system includes a second bypass pipe and a second bypass valve.

The first bypass pipe of the subcooling system connects a liquid refrigerant pipe and a low-pressure refrigerant pipe of the heat pump system. The refrigerant heat exchanger is configured to cause a heat-exchange between refrigerant flowing in the liquid refrigerant pipe and refrigerant flowing in first bypass pipe. The refrigerant flowing in first bypass pipe is decompressed and expanded by a first bypass valve disposed in the first bypass pipe to become cooler than the refrigerant flowing in the liquid refrigerant pipe. Thus, the refrigerant flowing in the liquid refrigerant pipe is cooled when flowing through heat-exchange. Opening degree of the first bypass valve is controlled such that temperature of the refrigerant flowing in the liquid refrigerant pipe is cooled down to a predetermine target temperature. Thereby, it is possible to improve cooling efficiency in a heat exchanger which is disposed on a downstream side of the liquid refrigerant pipe.

The second bypass pipe of the injection system also connects the liquid refrigerant pipe and the low-pressure refrigerant pipe. The refrigerant in second bypass pipe flows to the low-pressure refrigerant pipe without flowing through the heat exchanger, and merges with refrigerant which flew through the heat exchanger. Moreover, the refrigerant flowing in second bypass pipe is decompressed and expanded by a second bypass valve disposed in the second bypass pipe to become cooler than the refrigerant flowing in the low-pressure refrigerant pipe. Thus, refrigerant suctioned by the refrigerant compressor is cooled, and temperature of refrigerant discharged from the refrigerant compressor (hereinafter referred to as a "discharge temperature") is decreased consequently. Opening degree of the second bypass valve is controlled such that the discharge temperature is cooled down to another predetermine target temperature. Thereby, it is possible to improve reliability and safety of the heat pump system.

However, there are cases in which the discharge temperature cannot be sufficiently reduced by the above injection system due to its insufficient flow capability of refrigerant. Meanwhile, an increase in thickness and/or number of the second bypass pipe results in an increase in production cost and/or dimensions of the heat pump system. Moreover, if the amount of refrigerant bypassing through the second bypass is simply increased in order to further reduce the discharge temperature, the amount of refrigerant sent to the heat exchange is decreased. As a result, the performance of the heat pump system would be rather deteriorated.

CITATION LIST

Patent Literature

[PTL 1] WO2018/062177A1

SUMMARY OF INVENTION

The object of the present invention is to improve efficiency, reliability, and safety of a heat pump system while preventing an increase in production cost and/or dimensions of the system as much as possible.

A first aspect of the present invention provides a heat pump system, comprising: a refrigerant compressor; a high-pressure refrigerant pipe connected with a discharge port of the refrigerant compressor; a low-pressure refrigerant pipe connected with a suction port of the refrigerant compressor; a heat-source side heat exchanger connected to either one of the high-pressure refrigerant pipe and the low-pressure refrigerant pipe, and configured to cause a heat-exchange between refrigerant flowing therein and fluid passing therethrough; a liquid refrigerant pipe connected with the heat-source side heat exchanger, and configured to be connected to a utilization side heat exchanger which is configured to cause a heat-exchange between refrigerant flowing therein and fluid passing therethrough; a gas refrigerant pipe connected to another one of the high-pressure refrigerant pipe and the low-pressure refrigerant pipe, and configured to be connected to the utilization side heat exchanger; a main expansion mechanism disposed in the liquid refrigerant pipe; a first bypass pipe connected with the liquid refrigerant pipe at a point between the main expansion mechanism and the utilization side heat exchanger, and connected with the low-pressure refrigerant pipe or an injection port of the compressor; a refrigerant heat exchanger configured to cause a heat-exchange between refrigerant flowing in the liquid refrigerant pipe and refrigerant flowing in first bypass pipe; a first bypass valve disposed in the first bypass pipe at a point between the liquid refrigerant pipe and the refrigerant heat exchanger; a second bypass pipe connected with the liquid refrigerant pipe at a point between the main expansion mechanism and the utilization side heat exchanger, and connected with the low-pressure refrigerant pipe; a second bypass valve disposed in the second bypass pipe; a superheated temperature detector configured to detect parameters indicating superheated temperature of refrigerant flowing in the first bypass pipe; a discharge side sensor configured to detect, as discharge temperature, temperature of refrigerant flowing in the high-pressure refrigerant pipe between the refrigerant compressor and the either one of the heat-source side heat exchanger and the utilization side heat exchanger; and a controller configured to control opening degree of the first bypass valve based on the superheated temperature indicated by the detected parameters and discharge temperature, and control opening degree of the second bypass valve based on the discharge temperature.

With this configuration, the opening degree of the first bypass valve is controlled based on not only the superheated temperature but also the discharge temperature. Thereby, the first bypass pipe, which is originally provided for a subcooling system, can be utilized for supporting an injection system to reduce the discharge temperature in addition to the second bypass pipe. Thus, it is possible to increase flow capability of refrigerant bypassing the utilization side heat exchanger in order to reduce discharge temperature without increasing thickness and/or number of the second bypass pipe. Consequently, it is possible to improve efficiency, reliability, and safety of a heat pump system while preventing an increase in production cost and/or dimensions of the system as much as possible.

According to a preferred embodiment of the heat pump system mentioned above, the first bypass pipe is connected with the low-pressure refrigerant pipe; and the superheated temperature detector includes a bypass sensor configured to detect temperature of refrigerant flowing in the first bypass pipe on a downstream side of the refrigerant heat exchanger, and a suction-side sensor configured to detect pressure of refrigerant flowing in the low-pressure refrigerant pipe.

With this configuration, it is possible to lead refrigerant flowing in the first bypass pipe to the low-pressure refrigerant pipe. Thus, even in a case where the refrigerant compressor does not have an injection port, it is possible to utilize the first bypass pipe to decrease the discharge temperature. Moreover, it is possible to detect the superheated temperature by using a temperature sensor and a pressure sensor which are easily and reasonably available. Thus, it is possible to improve the efficiency of the heat pump system while avoiding an increase in the production cost of the system.

According to another preferred embodiment of any one of the heat pump systems mentioned above, the first bypass pipe is connected with the injection port of the compressor; and the superheated temperature detector includes a first bypass sensor configured to detect temperature of refrigerant flowing in the first bypass pipe on a downstream side of the refrigerant heat exchanger, and a second bypass sensor configured to detect temperature of refrigerant flowing in the first bypass pipe between the first bypass valve and the refrigerant heat exchanger, or a first bypass sensor configured to detect temperature of refrigerant flowing in the first bypass pipe on a downstream side of the refrigerant heat exchanger, and a second bypass sensor configured to detect pressure of refrigerant flowing in the first bypass pipe on a downstream side of the first bypass valve.

With this configuration, it is possible to lead refrigerant flowing in the first bypass pipe to the injection port of the refrigerant compressor. Thus, it is possible to utilize the first bypass pipe to decrease the discharge temperature while improving the efficiency of the refrigerant compressor. Moreover, it is possible to detect the superheated temperature by a using a temperature sensor and a pressure sensor or another temperature sensor which are easily and reasonably available. Thus, it is possible to improve the efficiency of the heat pump system while avoiding an increase in the production cost of the system. When two temperature sensors are used and one of them is disposed between the first bypass valve and the refrigerant heat exchanger, the superheated temperature can be obtained more easily.

According to further another preferred embodiment of any one of the heat pump systems mentioned above in which the first bypass pipe is connected with the low-pressure refrigerant pipe, the system further comprises an accumulator disposed in the low-pressure refrigerant pipe, wherein: the first bypass pipe is connected with the low-pressure refrigerant pipe at a point between the accumulator and either one of the heat-source side heat exchanger and the utilization side heat exchanger which is connected with the low-pressure refrigerant pipe; and the second bypass pipe is connected with the low-pressure refrigerant pipe at a point between the accumulator and the refrigerant compressor.

With this configuration, the refrigerant which has flown in the first bypass pipe is received by the accumulator, and the refrigerant which has flown in the second bypass pipe is not received by the accumulator. The refrigerant flown in the first bypass tends to contain less liquid refrigerant due to a heat exchange in the refrigerant heat exchanger, while the refrigerant flown in the second bypass pipe tends to contain more liquid refrigerant. Thus, it is possible to send the refrigerant in liquid form or gas-liquid two-phase form to the low-pressure refrigerant pipe so as to efficiently perform a so-called liquid injection.

According to further another preferred embodiment of any one of the heat pump systems mentioned above in which the first bypass pipe is connected with the injection port of the compressor, the system further comprises: an accumulator disposed in the low-pressure refrigerant pipe, wherein the second bypass pipe is connected with the low-pressure refrigerant pipe at a point between the accumulator and the refrigerant compressor.

With this configuration, the refrigerant which has flown in the second bypass pipe is not received by the accumulator. The refrigerant which has flown in the second bypass pipe tends to contain more liquid refrigerant. Thus, it is possible to send the refrigerant in liquid form or gas-liquid two-phase form to the low-pressure refrigerant pipe so as to efficiently perform a so-called liquid injection.

According to further another preferred embodiment of any one of the heat pump systems mentioned above, the controller is configured to increase the opening degree of the first bypass valve at least when the opening degree of the second bypass valve has reached a first opening degree threshold.

With this configuration, an increase in the opening degree of the second bypass valve triggers an increase in the opening degree of the first bypass valve. Thereby, the opening degree of the first bypass valve can be quickly increased before the discharge temperature increases excessively. Thus, it is possible to swiftly decrease the discharge temperature and effectively prevent the discharge temperature from becoming excessively high. Moreover, there might be a case where the second bypass valve still has a potential to decrease the discharge temperature although the discharge temperature is high. Hence, it is possible to prevent the opening degree of the first bypass valve from unnecessarily increased.

According to further another preferred embodiment of any one of the heat pump systems mentioned above, the controller is configured to increase the opening degree of the first bypass valve at least when the discharge temperature has reached a discharge temperature threshold.

With this configuration, an increase in the discharge temperature triggers an increase in the opening degree of the first bypass valve. When the discharge temperature is high, the second bypass valve is possibly already widely open. Thus, by the above trigger, it is possible to decrease the discharge temperature more reliably. Moreover, there might be a case where the discharge temperature is not high while the second bypass valve is widely open. Hence, it is possible to prevent the opening degree of the first bypass valve from unnecessarily increased.

According to further another preferred embodiment of any one of the heat pump systems mentioned above, the controller is configured to control the opening degree of the first bypass valve such that: the superheat temperature approaches a target superheat temperature when the discharge temperature is lower than or equal to a first target discharge temperature; and the discharge temperature approaches the first target discharge temperature when the discharge temperature is higher than the first target discharge temperature.

With this configuration, the first bypass pipe functions to regulate the superheat temperature when the discharge temperature is kept low, and functions to regulate the discharge temperature when the discharge temperature has increased to the first target discharge temperature. Thus, it is possible to prevent the discharge temperature from becoming excessively high by utilizing the first bypass pipe, while exerting the function of the first bypass pipe as the subcooling system as much as possible to improve the efficiency of the heat pump system. Moreover, the first bypass valve can be opened when the second bypass valve still has a potential to decrease the discharge temperature. Overall effect of reducing the discharge temperature by the second bypass valve is greater than that of the first bypass valve. Hence, it is possible to quickly decrease the discharge temperature. Furthermore, there might be a case where the discharge temperature is not high while the second bypass valve is widely open. Hence, it is possible to prevent the opening degree of the first bypass valve from unnecessarily increased.

According to further another preferred embodiment of the heat pump system mentioned above in which the controller is configured to control the opening degree of the first bypass valve such that the discharge temperature approaches the first target discharge temperature when the discharge temperature is higher than the first target discharge temperature, the controller is configured to decrease the value of the first target discharge temperature when the opening degree of the second bypass valve has reached a first opening degree threshold.

With this configuration, the more the second bypass valve opens, the more the opening degree of the first bypass valve becomes likely to be controlled based on the discharge temperature. Thus, it is possible to decrease the discharge temperature more reliably.

According to further another preferred embodiment of the heat pump system mentioned above in which the controller is configured to decrease the value of the first target discharge temperature when the opening degree of the second bypass valve has reached a first opening degree threshold, the controller is configured to increase the value of the first target discharge temperature when the opening degree of the second bypass valve has decreased to a second opening degree threshold which is lower than or equal to the first opening degree threshold.

With this configuration, when the first bypass pipe does not need to function to regulate the discharge temperature anymore, the first bypass pipe returns to functioning to regulate the superheat temperature. Thus, it is possible to exert the function of the first bypass pipe as the subcooling system as much as possible to improve the efficiency of the heat pump system.

According to further another preferred embodiment of any one of the heat pump systems mentioned above, the controller is configured to control the opening degree of the first bypass valve such that: the superheat temperature approaches a target superheat temperature when the opening degree of the second bypass valve is lower than a first opening degree threshold; and the discharge temperature approaches a first target discharge temperature when the opening degree of the second bypass valve is higher than the first opening degree threshold.

With the above configuration, the first bypass pipe functions to regulate the superheat temperature when the opening degree of the second bypass valve is kept low, and functions to regulate the discharge temperature when the opening degree of the second bypass valve has increased. Thus, it is possible to prevent the discharge temperature from becoming excessively high by utilizing the first bypass pipe, while exerting the function of the first bypass pipe as the subcooling system as much as possible to improve the efficiency of the heat pump system. Moreover, the opening degree of the first bypass valve is opened after already a large potential of the second bypass valve to reduce the discharge temperature has been used. There might be a case where the second bypass valve still has a potential to decrease the discharge temperature although the discharge temperature is high. Hence, it is possible to prevent the opening degree of the first bypass valve from being unnecessarily increased. Furthermore, the opening degree of the first bypass valve can be quickly increased before the discharge temperature has increased excessively. Thus, it is possible to swiftly decrease the discharge temperature and effectively prevent the discharge temperature from becoming excessively high.

According to further another preferred embodiment of any one of the heat pump systems mentioned above which uses the first target discharge temperature, the controller is configured to switch from a first control in which the opening degree of the first bypass valve is controlled such that the discharge temperature approaches the first target discharge temperature to a second control in which the opening degree of the first bypass valve is controlled such that the superheat temperature approaches the target superheat temperature when: the discharge temperature has decreased to a second target discharge temperature which is lower than or equal to the first target discharge temperature; and/or the opening degree of the second bypass valve has decreased to a second opening degree threshold which is lower than or equal to the first opening degree threshold.

With this configuration, when the first bypass pipe does not need to function to regulate the discharge temperature anymore, the first bypass pipe returns to functioning to regulate the superheat temperature. Thus, it is possible to exert the function of the first bypass pipe as the subcooling system as much as possible to improve the efficiency of the heat pump system.

According to further another preferred embodiment of any one of the heat pump systems mentioned above, the heat pump system is configured to use R32 refrigerant.

R32 refrigerant, which is also called HFC-32 refrigerant or difluoromethane refrigerant and with a chemical formula of $CH_2F_2$, has characteristics of the zero ozone depletion potential and the low global warming potential. Meanwhile, the discharge temperature tends to become relatively high when R32 refrigerant is used. In this regard, the heat pump system according to any one of the heat pump systems mentioned above can decrease the discharge temperature. Thus, it is possible to achieve an eco-friendly heat pump system while ensuring high reliability and safety.

According to further another preferred embodiment of any one of the heat pump systems mentioned above, the system further comprises: a mode switching mechanism configured to switch the state of the heat pump system between a cooling operation mode in which the heat-source side heat exchanger is connected to the high-pressure refrigerant pipe and the gas refrigerant pipe is connected to the low-pressure refrigerant pipe, and a heating operation mode in which the heat-source side heat exchanger is connected to the low-pressure refrigerant pipe and the gas refrigerant pipe is connected to the high-pressure refrigerant pipe; and a connection switching mechanism configured to switch the state of the second bypass pipe between a first connection mode in which the second bypass pipe is connected with the liquid refrigerant pipe at a point between the refrigerant heat exchanger and the utilization side heat exchanger, and a second connection mode in which the second bypass pipe is connected with the liquid refrigerant pipe at a point between the main expansion mechanism and the refrigerant heat exchanger, wherein the controller is further configured to control the connection switching mechanism such that the second bypass pipe is in the first connection mode when the heat pump system is in the cooling operation mode, and the second bypass pipe is in the second connection mode when the heat pump system is in the heating operation mode.

With this configuration, it is possible to switch the operation mode of the heat pump system between a cooling operation mode in which the utilization side heat exchanger functions as an evaporator and a heating operation mode in which the utilization side heat exchanger functions as a condenser. Moreover, the second bypass pipe can always be connected to a downstream side of the refrigerant heat exchanger regardless of the operation mode so as to bypass the refrigerant with lower temperature. Thus, it is possible to decrease the discharge temperature more effectively during both the cooling operation mode and the heating operation mode.

A second aspect of the present invention provides a method for controlling the heat pump system according to any one of the heat pump systems mentioned above, comprising: controlling the opening degree of the first bypass valve such that the superheat temperature approaches a target superheat temperature when the discharge temperature is lower than or equal to a first target discharge temperature, and such that the discharge temperature approaches the first target discharge temperature when the discharge temperature is higher than the first target discharge temperature; and decreasing the value of the first target discharge temperature when the opening degree of the second bypass valve has reached the first opening degree threshold.

By the above method, the first bypass pipe functions to regulate the superheat temperature when the discharge temperature is kept low, and functions to regulate the discharge temperature when the discharge temperature has increased. Thus, it is possible to prevent the discharge temperature from becoming excessively high, while improving the efficiency of the heat pump system as much as possible.

BRIEF DESCRIPTION OF DRAWINGS

FIG. 1 is a schematic configuration view of a heat pump system according to a first embodiment of the present invention;

FIG. 2 is a block diagram indicating a functional configuration of a controller shown in FIG. 1;

FIG. 3 is a flow chart indicating the process performed by the controller;

FIG. 4 is a schematic configuration view of a heat pump system according to a second embodiment of the present invention;

FIG. 5 is a schematic configuration view of a heat pump system according to a third embodiment of the present invention;

FIG. 6 is a block diagram indicating a functional configuration of a controller shown in FIG. 5; and FIG. 7 is a flow chart indicating the process performed by the controller.

DESCRIPTION OF EMBODIMENTS

First Embodiment

A preferred embodiment of a heat pump system according to the present invention (hereafter referred to as "the first embodiment") will be described with reference to the drawings. The heat pump system according to the first embodiment is a refrigeration system for cooling a target space by using R32 refrigerant, for instance.

—Circuit Configuration of the System—

FIG. 1 is a schematic configuration view of a heat pump system according to the first embodiment.

As shown in FIG. 1, the heat pump system 100 according to the first embodiment includes a utilization side unit 200 and a heat-source side unit 300 forming a heat pump circuit. The utilization side unit 200 is disposed in the target space, and the heat-source side unit 300 is disposed outside the target space, for instance. The utilization side unit 200 and the heat-source side unit 300 may be produced separately and then connected to each other via later-mentioned pipes. Alternatively, the utilization side unit 200 and the heat-source side unit 300 may be integrated as a single unit. A plurality of the utilization side unit 200 may be connected to the one or a plurality of the heat-source side units 300.

The utilization side unit 200 includes a utilization side expansion mechanism 211 and utilization side HEX (heat exchanger) 212. The elements of the utilization side unit 200 may be accommodated in a housing (not shown).

The utilization side expansion mechanism 211 is disposed in a later-mentioned liquid refrigerant pipe 322 which extends from the heat-source side unit 300, and configured to decompress and expand refrigerant flowing in the liquid refrigerant pipe from the heat-source side unit 300. The utilization side expansion mechanism 211 may be an electric expansion valve. The utilization side HEX 212 is connected with an end of the liquid refrigerant pipe 322, and also connected with an end of a later-mentioned gas refrigerant pipe 323 which extends from the heat-source side unit 300. The utilization side HEX 212 is configured to cause a heat-exchange between refrigerant flowing therein from the liquid refrigerant pipe 322 and the gas refrigerant pipe 323 and fluid passing therethrough. When the refrigerant in the liquid refrigerant pipe 322 flows towards the utilization side HEX 212, the refrigerant is decompressed and expanded by the utilization side expansion mechanism 211. The fluid passing through the utilization side HEX 212 may be air, water, or another refrigerant. The utilization side HEX 212 may be provided with a fan, a pump or the like to facilitate the flow of the fluid.

The heat-source side unit 300 includes a refrigerant compressor 311, a heat-source side HEX 312, a main expansion mechanism 313, a refrigerant HEX (heat exchanger) 314, a liquid side stop valve 315, a gas side stop valve 316, and an accumulator 317.

The heat-source side unit 300 also includes a high-pressure refrigerant pipe 321, the liquid refrigerant pipe 322, the gas refrigerant pipe 323, a low-pressure refrigerant pipe 324, a first bypass pipe 331, and a second bypass pipe 332. The heat-source side unit 300 further includes a first bypass valve 341, a second bypass valve 342, a bypass sensor 351, a suction side sensor 352, a discharge side sensor 353, and a controller 400. The elements of the heat-source side unit 300 may be accommodated in a housing (not shown).

The refrigerant compressor 311 has a suction port and a discharge port (not shown), and configured to suction refrigerant via the suction port, compress the suctioned refrigerant, and discharge the compressed refrigerant from the discharge port. An end of the low-pressure refrigerant pipe 324 is connected with the suction port, and an end of the high-pressure refrigerant pipe 321 is connected with the discharge port.

The heat-source side HEX 312 is connected to another end of the high-pressure refrigerant pipe 321, and also connected with another end of the liquid refrigerant pipe 322. The heat-source side HEX 312 is configured to cause a heat-exchange between refrigerant flowing therein from the high-pressure refrigerant pipe 321 to the liquid refrigerant pipe 322 and fluid passing therethrough. The refrigerant flowing into the heat-source side HEX 312 is the refrigerant compressed by the refrigerant compressor 311. The fluid passing through the heat-source side HEX 312 may be air, water, or another refrigerant. The heat-source side HEX 312 may be provided with a fan, a pump or the like to facilitate the flow of the fluid.

The main expansion mechanism 313 is disposed in the liquid refrigerant pipe 322, and configured to decompress and expand refrigerant flowing in the liquid refrigerant pipe 322 from the heat-source side HEX 312. The main expansion mechanism 313 may be an electric expansion valve.

The refrigerant HEX 314 is configured to cause a heat-exchange between refrigerant flowing in the liquid refrigerant pipe 322 and refrigerant flowing in the first bypass pipe 331. The refrigerant HEX 314 may have two flow channels which have thermal conductance therebetween. The two flow channels form a part of the liquid refrigerant pipe 322 and a part of the first bypass pipe 331, respectively.

The liquid side stop valve 315 is disposed in a farthermost part of the liquid refrigerant pipe 322 from the refrigerant compressor 311 within the heat-source side unit 300, and capable of stopping refrigerant flowing out from the heat-source side unit 300 via the liquid refrigerant pipe 322. The liquid side stop valve 315 may be an electric expansion valve.

Another end of the gas refrigerant pipe 323 is connected with another end of the low-pressure refrigerant pipe 324. Thus, the utilization side HEX 212 of the utilization side unit 200 is connected to the refrigerant compressor 311 via the gas refrigerant pipe 323 and the low-pressure refrigerant pipe 324.

The gas side stop valve 316 is disposed in a farthermost part of the gas refrigerant pipe 323 from the refrigerant compressor 311 within the heat-source side unit 300, and capable of stopping refrigerant flowing into the heat-source side unit 300 via the gas refrigerant pipe 323. The gas side stop valve 316 may be an electric expansion valve.

The accumulator 317 is disposed in the low-pressure refrigerant pipe 324, and configured to accumulate excess refrigerant in the heat pump circuit. The accumulator 317 is also configured to separate gas refrigerant from the refrigerant flown into the accumulator 317, and forward the separated gas refrigerant to the refrigerant compressor 311.

An end of the first bypass pipe 331 is connected with the liquid refrigerant pipe at a point P1 between the main expansion mechanism 313 and the refrigerant HEX 314. Another end of the first bypass pipe 331 is connected with the low-pressure refrigerant pipe 324 at a point P2 between the accumulator 317 and the utilization side HEX 212, i.e. between the accumulator 317 and the gas refrigerant pipe 323.

The first bypass valve 341 (EVT) is disposed in the first bypass pipe 331 at a point between the point P1 and the refrigerant HEX 314, and configured to decompress and expand refrigerant flowing in the first bypass pipe 331 from the liquid refrigerant pipe 322. Thus, the first bypass valve 341 is configured to supply gas-liquid two-phase refrigerant with temperature lower than the refrigerant flowing in the liquid refrigerant pipe 322 into the refrigerant HEX 314. Thereby, the refrigerant flowing in the liquid refrigerant pipe 322 is cooled when passing through the refrigerant HEX 314. The first bypass valve 341 is also capable of shutting off the refrigerant flow. The first bypass valve 341 may be an electric expansion valve.

An end of the second bypass pipe 332 is connected with the liquid refrigerant pipe 322 at a point P3. In this embodiment, the point P3 is located between the refrigerant HEX 314 and the liquid side stop valve 315. Another end of the second bypass pipe 332 is connected with the low-pressure refrigerant pipe at a point P4 between the accumulator 317 and the refrigerant compressor 311.

The second bypass valve 342 (EVL) is disposed in the second bypass pipe 332, and configured to decompress and expand refrigerant flowing in the second bypass pipe 332 from the liquid refrigerant pipe 322. Thus, the second bypass valve 341 is configured to supply gas-liquid two-phase refrigerant with temperature lower than the refrigerant flowing from the gas refrigerant pipe 323 to the low-pressure refrigerant pipe 324. This refrigerant with lower temperature merges with the refrigerant discharged from the accumulator 317 to decrease temperature of the refrigerant which is to be suctioned by the refrigerant compressor 311. The second bypass valve 342 is also capable of shutting off the refrigerant flow. The second bypass valve 342 may be an electric expansion valve.

The bypass sensor 351 is attached to the first bypass pipe 331 at a point between the refrigerant HEX 314 and the point P2. The bypass sensor 351 is configured to detect temperature of refrigerant flowing in the first bypass pipe 331 on a downstream side of the refrigerant HEX 314 (hereinafter referred to as "the bypass refrigerant temperature Tsh"), and output a signal indicating the detected bypass refrigerant temperature Tsh to the controller 400. The bypass sensor 351 may be a thermistor.

The suction side sensor 352 is attached to the low-pressure refrigerant pipe 324 on an upstream side of the point P2. The suction side sensor 352 is configured to detect pressure of refrigerant flowing in the low-pressure refrigerant pipe 324 (hereinafter referred to as "the suction side pressure Psu"), and output a signal indicating the detected suction side pressure Psu to the controller 400. The suction side sensor 352 may be a capacitive pressure sensor.

Saturation temperature Teg of the refrigerant flowing in the low-pressure refrigerant pipe can be identified from the suction side pressure Psu when the refrigerant used is known. Superheat temperature SH of the refrigerant flowing in the first bypass pipe 331 can be identified from the difference of the bypass refrigerant temperature Tsh relative to the saturation temperature Teg. Thus, it can be said that the bypass sensor 351 and the suction side sensor 352 form a superheated temperature detector which is configured to detect the bypass refrigerant temperature Tsh and the suction side pressure Psu as parameters indicating the superheat temperature SH of refrigerant flowing in the first bypass pipe 331.

The discharge side sensor 353 is attached to the high-pressure refrigerant pipe 321. The discharge side sensor 353 is configured to detect temperature of refrigerant flowing in the high-pressure refrigerant pipe 321 (hereinafter referred to as "the discharge temperature Tdi"), and output a signal indicating the detected discharge temperature Tdi to the controller 400.

The controller 400 includes an arithmetic circuit such as a CPU (Central Processing Unit), a work memory used by the CPU such as a RAM (Random Access Memory), and a recording medium storing control programs and information used by the CPU such as a ROM (Read Only Memory), although they are not shown. The controller 400 is configured to perform information processing and signal processing by the CPU executing the control programs to control operation of the heat pump system 100. In particular, the controller 400 is configured to control opening degrees of the first and second bypass valves 341, 342.

With this configuration, when the refrigerant compressor 311 operates, the heat-source side HEX 312 and the utilization side HEX 212 function as a condenser and an evaporator of the heat pump circuit, respectively. Thereby, it is possible to cool the target space. In addition, when the first bypass valve 341 is open at a certain degree, the first bypass pipe 331 functions as a subcooling system for decreasing the temperature of the refrigerant flowing in the liquid refrigerant pipe 322. Thereby, it is possible to cool the refrigerant flowing in the liquid refrigerant pipe by the refrigerant heat exchange to improve cooling efficiency in the refrigerant HEX 314.

This configuration can be more effective when the piping length between the heat-source side unit 300 and the utilization side unit 200 is relatively long. In a case where the pipe length is long, pressure loss of the refrigerant in the liquid refrigerant pipe 322 tends to increase. In this regard, by opening the first bypass valve 341, it is possible to increase subcooling degree of refrigerant. As the result, it is possible to keep performance for cooling in the utilization side unit 200 though refrigerant circulation volume in the liquid refrigerant pipe 322 is decreased.

Moreover, when the second bypass valve 342 is open at a certain degree, the second bypass pipe 332 functions as an injection system to decrease the temperature of the refrigerant flowing in the low-pressure refrigerant pipe 324. Thereby, it is possible to decrease the discharge temperature Tdi to improve reliability and safety of the heat pump system 100. This configuration is more effective when R32 refrigerant is used.

The opening degrees of the first bypass valve 341 and the second bypass valve 342 are controlled by the controller 400 based on the signals from the bypass sensor 351, the suction side sensor 352, and the discharge side sensor 353 (hereinafter referred to as "the sensors" as necessary).

—Functional Configuration of the Controller—

FIG. 2 is a block diagram indicating a functional configuration of the controller 400.

As shown in FIG. 2, the controller 400 includes a storage section 410, an information input section 420, an operation section 430, an information output section 440, and a valve control section 450.

The storage section 410 stores information in a form readable by the valve control section 450. The stored information includes saturation temperature information and valve control information which are prepared in advance based on experiments or the like.

The saturation temperature information indicates a correlation between pressure and saturation temperature of the refrigerant used in the heat pump system 100. From saturation temperature information, it is possible to identify the saturation temperature Teg of refrigerant if the suction side pressure Psu thereof has been detected.

The valve control information indicates predetermined criteria for determining a value of a target superheat temperature SH_tgt. The target superheat temperature SH_tgt is 5 K (Kelvin), for instance. The target superheat temperature SH_tgt may be determined such that the refrigerant flowing in the first bypass pipe 331 on the downstream side of the refrigerant HEX 314 is kept in a gas form, but at lower temperature as much as possible. Thereby, it is possible to make use of a full potential of the refrigerant HEX 314 to generate subcooled liquid refrigerant in the liquid refrigerant pipe 322 while avoiding a negative impact to the discharge temperature due to excessive high superheat temperature.

The valve control information also indicates a first temperature value T1 and a third temperature value T3 of a first target discharge temperature Tdi_tgt1. The target superheat temperature SH_tgt and the first target discharge temperature Tdi_tgt1 are reference values used by the valve control section 450 for controlling the opening degree of the first bypass valve 341. The valve control information further indicates a second temperature value T2 of a second target discharge temperature Tdi_tgt2. The second target discharge temperature Tdi_tgt2 is a reference value used by the valve control section 450 controlling the opening degree of the second bypass valve 342.

Here, the first temperature value T1 is greater than any one of the second and third temperature values T2, T3. Preferably, the second temperature value T2 is less than the third temperature value T3. In a case where R32 refrigerant is used, the first temperature T1 is 115, the second temperature T2 is 95, and the third temperature T3 is 90 (degree Celsius), for instance. Yet, one or more of the first, second, and third temperature values T1, T2, T3 may be variable depending on a circumstance such as operation state of the heat pump system 100. In this case, the valve control information indicates predetermined criteria for determining the first, second, and/or third temperature values T1, T2, T3. These temperature values T1, T2, T3 may be determined such that degradations of oil and/or motor coil insulation materials used in the refrigerant compressor 311 are prevented.

In addition, the valve control information indicates an opening degree threshold ODth. The opening degree threshold ODth is a reference value used by the valve control section 450 for switching between the first temperature value T1 and the third temperature value T3.

The information input section 420 is configured to input information necessary for controlling the operation of the heat pump system 100. The information to be inputted includes the signals outputted from the sensors. The information input section 420 is configured to output the bypass refrigerant temperature Tsh, the suction side pressure Psu, and the discharge temperature Tdi indicated by the inputted signals to the valve control section 450 (hereinafter referred to as "the sensing results" as necessary). The information input section 420 obtains and output the sensing results in a regular basis or when the sensing results have changed. The information input section 420 may be a wired/wireless communication interface for communicating with the sensors (the signal lines are not shown).

The operation section 430 is configured to operate the heat pump system 100 to perform a heat pump operation by operating the refrigerant compressor 311, the utilization side expansion mechanism 211, the fans and the like. In addition, the operation section 430 is configured to operate the first bypass valve 341 and second bypass valve 342 in accordance with commands from the valve control section 450. The operation section 430 may be a wired/wireless communication interface for communicating with the above mechanisms, and may include a power-supply unit for the above mechanisms.

The information output section 440 is configured to output information to a user of the heat pump system 100 in accordance with commands from the valve control section 450. The information output section 440 may be a display device, an electric light, a loudspeaker, a wired/wireless communication interface for transmitting information to an information output device or the like.

The valve control section 450 is configured to increase the opening degree of the first bypass valve 341 at least when the opening degree of the second bypass valve 332 has reached the opening degree threshold ODth. The valve control section 450 includes a first valve control section 451, a second valve control section 452, and a mode control section 453.

The first valve control section 451 is configured to control the opening degree of the first bypass valve 341 such that, when the discharge temperature Tdi is lower than or equal to the first target discharge temperature Tdi_tgt1, the superheat temperature SH approaches the target superheat temperature SH_tgt (a second control). The first valve control section 451 is also configured to control the opening degree of the first bypass valve 341 such that, when the discharge temperature Tdi is higher than the first target discharge temperature Tdi_tgt1, the discharge temperature Tdi approaches the first target discharge temperature Tdi_tgt1 (a first control). The temperature value of the first target discharge temperature Tdi_tgt1 is determined by the mode control section 453 as explained later. The first valve control section 451 controls the opening degree of the first bypass valve 341 by outputting commands to the operation section 430.

The second valve control section 452 is configured to control the opening degree of the second bypass valve 342 such that, when the discharge temperature Tdi is lower than or equal to the second target discharge temperature Tdi_tgt2, the second bypass valve 342 is closed. This may include a state where the second bypass valve 342 is at the minimum opening degree but not completely closed. The second valve control section 452 is also configured to control the opening degree of the first bypass valve 342 such that, when the discharge temperature Tdi is higher than the second target discharge temperature Tdi_tgt2, the discharge temperature Tdi approaches the second target discharge temperature Tdi_tgt2. The temperature value of the second target discharge temperature Tdi_tgt2 is fixed to the second temperature value T2. Yet, it may be changed by the mode control section 453. The second valve control section 452 controls the opening degree of the second bypass valve 342 by outputting commands to the operation section 430.

The mode control section 453 is configured to decrease the value of the first target discharge temperature Tdi_tgt1 when the opening degree of the second bypass valve 342 has reached the opening degree threshold ODth. More specifically, the mode control section 453 is configured to switch the first target discharge temperature Tdi_tgt1 from the first temperature value T1 to the third temperature value T3 when the opening degree of the second bypass valve 342 has exceeded the opening degree threshold ODth.

With the above configuration, when the second bypass valve 342 is widely open, the controller 400 alleviates the condition for controlling the first bypass valve 341 based on the discharge temperature Tdi. Thus, the controller 400 can make the opening degree of the first bypass valve 341, which is normally controlled based on the superheat temperature SH, more likely to be controlled based on the discharge temperature Tdi so as to decrease the discharge temperature Tdi when there is a possibility that the discharge temperature becomes excessively high.

—Operation by the Controller—

FIG. 3 is a flow chart indicating the process performed by the controller 450.

In step S1100, the mode control section 453 initially sets the first temperature value T1 to the first target discharge temperature Tdi_tgt1, and sets the second temperature value T2 to the second target discharge temperature Tdi_tgt2. As mentioned above, the first temperature value T1 is higher than the second temperature value T2. Preferably, the first temperature value T1 is a value which the discharge temperature Tdi would not reach when the discharge temperature Tdi can be decreased by increasing the opening degree of the second bypass valve 342.

In step S1200, the valve control section 450 acquires the discharge temperature Tdi and superheat temperature SH. More specifically, the valve control section 450 acquires the bypass refrigerant temperature Tsh, the suction side pressure Psu, and the discharge temperature Tdi from the bypass sensor 351, the suction side sensor 352, and the discharge side sensor 353 via the information input section 420. Then, the valve control section 450 identifies the saturation temperature Teg from the suction side pressure Psu by referring to the saturation temperature information. The valve control section 450 identifies, as the superheat temperature SH, a value which is obtained by deducting the identified saturation temperature Teg from the bypass refrigerant temperature Tsh. The valve control section 450 may use moving averages of each of the sensing results.

In step S1300, the second valve control section 452 determines whether the acquired the discharge temperature Tdi is higher than the second target discharge temperature Tdi_tgt2 (i.e. the second temperature value T2). If the discharge temperature Tdi is lower or equal to the second target discharge temperature Tdi_tgt2 (S1300: No), the second valve control section 452 proceeds to step S1400. If the discharge temperature Tdi is higher than the second target discharge temperature Tdi_tgt2 (S1300: Yes), the second valve control section 452 proceeds to step S1500.

In step S1400, the second valve control section 452 control the second bypass valve 342 to be closed. If the second bypass valve 342 is already closed, the second valve control section 452 keeps this closed state. If the second bypass valve 342 is open, the second valve control section 452 closes the second bypass valve 342.

In step S1500, the second valve control section 452 controls the second bypass valve 342 to be open, while controlling the opening degree of the second bypass valve 342 based on the discharge temperature Tdi as mentioned above. More specifically, the second valve control section 452 controls the second bypass valve 342 such that the discharge temperature Tdi decreases to (approaches) the second target discharge temperature Tdi_tgt2 (i.e. the second temperature value T2) as much as possible.

When the second bypass valve 342 is widely open, it is difficult to decrease the discharge temperature Tdi anymore.

Thus, in step S1600, the mode control section 453 determines whether the opening degree of the second bypass valve 342 is higher than the opening degree threshold ODth. If the opening degree of the second bypass valve 342 is lower than or equal to the opening degree threshold ODth (S1600: No), the mode control section 453 proceeds to step S1700. If the opening degree of the second bypass valve 342 is higher than the opening degree threshold ODth (S1600: Yes), the mode control section 453 proceeds to step S1800.

In step S1700, the mode control section 453 keeps the first target discharge temperature Tdi_tgt1 as the initial value (i.e. the first temperature value T1). If the third temperature value T3 has been set in the later-mentioned step S1800 in a previous process cycle, the mode control section 453 sets the first temperature value T1 to the first target discharge temperature Tdi_tgt1.

In step S1800, the mode control section 453 sets the third temperature value T3 to the first target discharge temperature Tdi_tgt1. Thus, the value of the first target discharge temperature Tdi_tgt1 is decreased from the first temperature value T1 to the third temperature value T3 when the opening degree of the second bypass valve 342 has reached the opening degree threshold ODth. If the third temperature value T3 has already been set in a previous process cycle, the mode control section 453 keeps the first target discharge temperature Tdi_tgt1 as it is.

When the opening degree of the second bypass valve 332 has decreased to the opening degree threshold ODth while the first target discharge temperature Tdi_tgt1 is the third temperature value T3, the mode control section 453 increases the value of the first target discharge temperature Tdi_tgt1 from the third temperature value T3 to the first temperature value T1 in step S1700. However, the opening degree threshold ODth (a first opening degree threshold) used when the first target discharge temperature Tdi_tgt1 is the first temperature value T1 and the opening degree threshold ODth (a second opening degree threshold) used when the first target discharge temperature Tdi_tgt1 is the third temperature value T3 may be different. In this case, it is preferable that the second opening degree threshold is lower than the first opening degree threshold, in order to prevent the first target discharge temperature Tdi_tgt1 from being frequently changed in a short time period.

In step S1900, the first valve control section 451 determines whether the discharge temperature Tdi is higher than the first target discharge temperature Tdi_tgt1. The first target discharge temperature Tdi_tgt1 is either one of the first temperature value T1 and the third temperature value T3 depending on the determination result in step S1600 as mentioned above. If the discharge temperature Tdi is lower than or equal to the first target discharge temperature Tdi_tgt1 (S1900: No), the first valve control section 451 proceeds to step S2000. If the discharge temperature Tdi is higher than the first target discharge temperature Tdi_tgt1 (S1900: Yes), the first valve control section 451 proceeds to step S2100.

In step S2000, the first valve control section 451 controls the opening degree of the first bypass valve 341 based on the superheat temperature SH as mentioned above. More specifically, the first valve control section 451 determines the target superheat temperature SH_tgt based on the valve control information, and controls the opening degree of the first bypass valve 341 such that the superheat temperature SH approaches the target superheat temperature SH_tgt as much as possible.

In step S2100, the first valve control section 451 controls the opening degree of the first bypass valve 341 based on the discharge temperature Tdi as mentioned above. More specifically, the first valve control section 451 controls the first bypass valve 341 such that the discharge temperature Tdi decreases to (approaches) the first target discharge temperature Tdi_tgt1 (i.e. the first temperature value T1 or the third temperature value T3) as much as possible.

Hence, when the second bypass valve 342 is widely open exceeding the opening degree threshold ODth, the first target discharge temperature Tdi_tgt1 is decreased, and the second valve control section 452 becomes more likely to control the opening degree of the first bypass valve 341 so as to decrease the discharge temperature Tdi. In other words, the operation of the first bypass valve 341 is switched from an operation mainly for achieving the subcooling system to another operation mainly for decreasing the discharge temperature. An increase of the opening degree of the first bypass valve 341 results in that the refrigerant flowing in the liquid refrigerant pipe 322 is more subcooled, and thus enhances the cooling effect by the second bypass pipe 332.

The valve control section 450 may also output, in step S2100, alarm information by image, light, sound, communication signal or the like via the information output section 440 by outputting commands thereto to notify the user of possible excessive high discharge temperature. The valve control section 450 may output the alarm information based on other conditions, e.g. when the discharge temperature Tdi has reached a predetermined threshold or when the opening degree of the second bypass valve 342 has exceeded a predetermined opening degree threshold.

The valve control section 450 may also output command to the operation section 430 to stop the operation of the refrigerant compressor 311 when the discharge temperature Tdi is higher than a predetermined threshold higher than the first target discharge temperature Tdi_tgt1.

In step S2200, the controller 400 determines whether a termination of operation has been designated. The designation may be made by a user operation, another device, or the controller 400 itself. If the termination of the operation has not been designated (S2200: No), the controller 400 goes back to step S1200. If the termination of the operation has been designated (S2200: Yes), the controller 400 terminates its operation.

By the above operation of the controller 400, the heat pump system 100 can swiftly utilize the first bypass pipe 331 provided for the subcooling system for supporting the injection function of the second bypass pipe 332 when the injection function is insufficient.

It should be noted that the execution order of the above-mentioned steps S1300 to S1500, steps S1600 to S1800, and steps S1900 to S2100 may be changed. Moreover, the step of acquiring the discharge temperature Tdi in step S1200 may be executed at another timing which is before at least steps S1300 and S1900, and the step of acquiring the superheat temperature SH in step S1200 may be executed at another timing which is before at least step S2000.

Advantageous Effect

According to the first embodiment, by utilizing the first bypass pipe 331 and the first bypass valve 341 which are originally provided for subcooling of the refrigerant flowing in the liquid refrigerant pipe 322, it is possible to increase flow capability of refrigerant bypassing the utilization side HEX 212. Thereby, it is possible to effectively reduce the discharge temperature Tdi to prevent from becoming excessively high. Moreover, this effect can be achieved without increasing thickness and/or number of the second bypass pipe 332. Hence, efficiency, reliability, and safety of the heat pump system 100 can be improved while preventing an increase in production cost and/or dimensions of the system as much as possible.

When the heat pump circuit is relatively long, and/or a specific refrigerant such as R32 refrigerant is used, the discharge temperature Tdi tends to become high. Thus, the above configuration is suitable for such a heat pump system having a long circuit. In other words, it is possible to control the discharge temperature within acceptable limits regardless of the piping situation.

If the thickness and/or the number of the second bypass pipe 332 is simply increased in order to improve the flow capacity of the second bypass pipe 332, the production cost and/or the dimensions of the heat-source side unit 300 would be increased. Thus, it is possible to provide the heat pump system 100 with high efficiency, reliability, and safety while preventing an increase in production cost and/or dimensions of the system as much as possible.

Modifications of the First Embodiment

In the above embodiment, the trigger for switching the value of the first target discharge temperature Tdi_tgt1 is that the opening degree of the second bypass valve 342 has exceeded the opening degree threshold ODth. However, the trigger may be that the discharge temperature Tdi has reached a discharge temperature threshold. Thus, controller 400 may be configured to increase the opening degree of the first bypass valve 341 when the opening degree of the second bypass valve 342 has reached the opening degree threshold ODth and/or the discharge temperature Tdi has reached a discharge temperature threshold. Thereby, it is also possible to effectively reduce the discharge temperature Tdi to prevent from becoming excessively high.

In addition, in the above embodiment, the high-pressure refrigerant pipe 321 is connected with the heat-source side HEX 312, and the low-pressure refrigerant pipe 324 connected to the utilization side HEX 212 via the gas refrigerant pipe 323. However, the high-pressure refrigerant pipe 321 may be connected to the utilization side HEX 212 via the gas refrigerant pipe 323, and the low-pressure refrigerant pipe 324 may be connected with the heat-source side HEX 312. In this configuration, the heat-source side HEX 312 and the utilization side HEX 212 function as an evaporator and a condenser of the heat pump circuit, respectively. It is preferable that the connection point P3 of the second bypass pipe 332 is located at a downstream side of the refrigerant HEX 314.

Second Embodiment

Another preferred embodiment of the heat pump system according to the present invention (hereafter referred to as "the second embodiment") will be described with reference to the drawing. The heat pump system according to the second embodiment has substantially the same features as the heat pump system 100 according to the first embodiment mentioned above, except for the features explained below.

FIG. 4 is a schematic configuration view of a heat pump system according to the second embodiment.

As shown FIG. 4, in the heat-source side unit 300*a* of the heat pump system 100*a* according to this embodiment, the first bypass pipe 331*a* is connected not with the low-pressure refrigerant pipe 324 but with the injection port of the refrigerant compressor 311 (the point P5). The injection port is in communication with an intermediate pressure chamber of the refrigerant compressor 311.

To the first bypass pipe 331*a*, the bypass sensor (hereinafter referred to as "the first bypass sensor 351") which is identical to the bypass sensor 351 of the first embodiment and another bypass sensor (hereinafter referred to as "the second bypass sensor 351*a*") are attached. There may be two patterns in the sensor types of the first and second bypass sensors 351, 351*a*.

In the first pattern, the first bypass sensor 351 is configured to detect temperature of refrigerant flowing in the first bypass pipe 331*a* on a downstream side of the refrigerant HEX 314, and the second bypass sensor 351*a* is configured to detect temperature of refrigerant flowing in the first bypass pipe 331*a* between the first bypass valve 341 and the refrigerant HEX 314.

In the second pattern, the first bypass sensor 351 is configured to detect temperature of refrigerant flowing in the first bypass pipe 331*a* on a downstream side of the first bypass valve 341, and the second bypass sensor 351*a* is configured to detect pressure of refrigerant flowing in the first bypass pipe 331*a* on a downstream side of the first bypass valve 341. Thus, in the second pattern, the second bypass sensor 351*a* need not be positioned between the first bypass valve 341 and the refrigerant HEX 314.

The refrigerant flowing from the first bypass valve 341 to the refrigerant HEX 314 in the first bypass pipe 331*a* is in gas-liquid two-phase. Thus, the second bypass sensor 351*a* in the first pattern can detect saturation temperature Ts of the refrigerant flowing in the first bypass pipe 331*a*. Thus, in the case of the first pattern, the controller 400 can easily obtain the superheat temperature SH of the refrigerant flowing in the first bypass pipe 331*a* just by deducting the temperature detected by the second bypass sensor 351*a* from the temperature detected by the first bypass sensor 351.

In the case of the second pattern, the pressure detected by the second bypass sensor 351*a* can be utilized in the same manner as the suction side pressure Psu of the embodiment. Thus, the superheat temperature SH of the refrigerant flowing in the first bypass pipe 331*a* can be anyway obtained by the same manner as the first embodiment.

Since the refrigerant used in the refrigerant HEX 314 is injected to the injection port of the refrigerant compressor 311, it is possible to improve efficiency of the refrigerant compressor 311. Moreover, it is possible to efficiently decrease the discharge temperature Tdi by controlling the first bypass valve 341 based on the discharge temperature Tdi.

Third Embodiment

Further another preferred embodiment of the heat pump system according to the present invention (hereafter referred to as "the third embodiment") will be described with reference to the drawings. The heat pump system according to the third embodiment has substantially the same features as the heat pump system 100 according to the first embodiment mentioned above, except for the features explained below.

FIG. 5 is a schematic configuration view of a heat pump system according to the third embodiment.

As shown FIG. 5, the heat-source side unit 300*b* of the heat pump system 100*b* according to this embodiment further comprises a mode switching mechanism 325*b* and a connection switching mechanism 333*b*.

The mode switching mechanism 325*b* is configured to switch the state of the heat pump system 100*b* between a cooling operation mode and a heating operation mode. In the cooling operation mode, the heat-source side HEX 312 is connected to the high-pressure refrigerant pipe 321, and the gas refrigerant pipe 323 is connected to the low-pressure refrigerant pipe 324. This connection state corresponds to the configuration of the first embodiment, FIG. 1, and depicted by broken lines in the mode switching mechanism 325*b* of FIG. 5. In the heating operation mode, the heat-source side HEX is connected to the low-pressure refrigerant pipe 324 and the gas refrigerant pipe 323 is connected to the high-pressure refrigerant pipe 321. This connection state is depicted by solid lines in the mode switching mechanism 325*b* of FIG. 5. The mode switching mechanism 325*b* may be a four-way selector valve, or a combination of branching pipes and select valves.

The connection switching mechanism 333*b* is configured to switch the state of the second bypass pipe between a first connection mode and a second connection mode. In the first connection mode, the second bypass pipe 332 is connected with the liquid refrigerant pipe 322 at the point P3, as the same as the first embodiment. In the second connection mode, the second bypass pipe 332 is connected with the liquid refrigerant pipe 322 at a point P6 between the main expansion mechanism 313 and the refrigerant HEX 314. The connection state of the first connection mode is depicted by a broken line in the connection switching mechanism 333*b* of FIG. 5, and the connection state of the second connection mode is depicted by a solid line in the connection switching mechanism 333*b* of FIG. 5. The connection switching mechanism 333*b* may be two connection pipes branched from the second bypass pipe 332 and two stop valves such as solenoid valves disposed in the two connection pipes, respectively.

The heat-source side unit 300*b* also has a controller 400*b* which has functions in addition to the functions of the controller 400 of the first embodiment.

FIG. 6 is a block diagram indicating a functional configuration of the controller 400*b*.

As shown in FIG. 6, the controller 400*b* includes an operation section 430*b* which has functions in addition to the functions of the operation section 430 of the first embodiment, and the valve control section 450*b* of the controller 400*b* further includes a connection control section 454*b*.

The operation section 430*b* is further configured to the operate mode switching mechanism 325*b* to switch the state of the heat pump system 100*b* between the cooling operation mode and the heating operation mode mentioned above. The operation section 430*b* is configured to switch the above state in accordance with commands from the valve control section 450*b*, a determination made by the operation section 430*b* itself, or a user operation. The operation section 430*b* is also configured to operate the connection switching mechanism 333*b* in accordance with commands from the valve control section 450*b*.

The connection control section 454*b* is configured to control the connection switching mechanism 325*b* via the operation section 430*b*. The connection control section 454*b* is configured to control the connection switching mechanism 325*b* such that the second bypass pipe 332 is in the first connection mode when the heat pump system 100*b* is in the cooling operation mode, and the second bypass pipe 332 is in the second connection mode when the heat pump system 100*b* is in the heating operation mode.

FIG. 7 is a flow chart indicating the process performed by the controller 400*b*.

Firstly, the controller 400*b* executes step S1100 of the first embodiment shown in FIG. 3. Then, in step S1110*a* and step S1120*b*, the connection control section 454*b* determines whether the heat pump system 100*b* is to be operated in the cooling operation mode or the heating operation mode. If the heat pump system 100*b* is to be operated in the cooling operation mode (S1100*b*: Yes), the connection control section 454*b* proceeds to step S1130*b*. If the heat pump system 100*b* is to be operated in the heating operation mode (S1120*b*: Yes), the connection control section 454*b* proceeds to step S1140*b*. The determination steps S1110*a* and step S1120*b* may be repeated (S1110*a*: No, S1120*b*: No).

In step S1130*b*, the connection control section 454*b* controls the connection switching mechanism 333*b* such that the second bypass pipe 332 is connected to the point P3. Then, the controller 400*b* executes steps S1200 to S2100 of the first embodiment shown in FIG. 3.

In step S2110*b*, the controller 400*b* determines whether a termination of operation has been designated. If the termination of the operation has not been designated (S2110*b*: No), the controller 400*b* goes back to step S1130*b*. If the termination of the operation has been designated (S2110*b*: Yes), the controller 400*b* terminates its operation. The termination of the operation may include the change of operation mode between the cooling operation mode and the heating operation mode.

On the other hand, in step S1140*b*, the connection control section 454*b* controls the connection switching mechanism 333*b* such that the second bypass pipe 332 is connected to the point P6. Then, the controller 400*b* executes steps S1200 to S2100 of the first embodiment shown in FIG. 3. However, step S2000 is replaced with step S2000*b* in which the first valve control section 451 closes the first bypass valve 341. This may include a state where the first bypass valve 341 is at the minimum opening degree but not completely closed.

In step S2120*b*, the controller 400*b* determines whether a termination of operation has been designated. If the termination of the operation has not been designated (S2120*b*: No), the controller 400*b* goes back to step S1140*b*. If the termination of the operation has been designated (S2120*b*: Yes), the controller 400*b* terminates its operation.

With the above configuration, it is possible to switch the operation mode of the heat pump system 100*b* between the cooling operation mode and the heating operation mode while the second bypass pipe 332 being always connected to a downstream side of the refrigerant HEX 314. The temperature of the refrigerant flowing in the liquid refrigerant pipe 322 is decreased by the refrigerant HEX 314. Thus, it is possible to decrease the temperature of the refrigerant flowing in the second bypass pipe 332 to decrease the discharge temperature Tdi more effectively during both the cooling operation mode and the heating operation mode.

Other Modifications

While only selected embodiments have been chosen to illustrate the present invention, it will be apparent to those skilled in the art from this disclosure that various changes and modifications can be made herein without departing from the scope of the invention as defined in the appended claims.

The controller 400, 400*b* may be configured to just increase the opening degree of the first bypass valve 341, without executing steps S1700 to S2100 shown in FIGS. 3 and 7, when the opening degree of the second bypass valve 332 has reached the opening degree threshold ODth. Alternatively, or additionally, the controller 400, 400*b* may be configured to just increase the opening degree of the first bypass valve 341, without executing steps S1700 to S2100 shown in FIGS. 3 and 7, when the discharge temperature Tdi has reached a discharge temperature threshold.

The arrangement of the elements of the heat-source side unit 300 and the utilization side unit 200 is not limited to the above-mentioned arrangements. For instance, the heat-source side HEX 312 may be disposed outside the housing of the heat-source side unit 300. Moreover, the heat pump systems 100, 100*a* of the first and second embodiments may be configured such that the heat-source side HEX 312 functions as an evaporator and the utilization side HEX 212 functions as a condenser. In this case, the pipe connections of the heat pump system 100*b* of the third embodiment in the heating operation mode may be applied. Thereby, it is possible to supply a hot heat to the utilization side unit 200 by the refrigerant.

The configurations of two or more of the first to third embodiments may be combined. For instance, the mode switching mechanism 325*b* of the third embodiment may be applied to the first or second embodiment. The first bypass pipe 331*a* of the second embodiment may be applied to the third embodiment.

Moreover, unless specifically stated otherwise, the size, shape, location or orientation of the various components can be changed as needed and/or desired so long as the changes do not substantially affect their intended function. Unless specifically stated otherwise, components that are shown directly connected or contacting each other can have intermediate structures disposed between them so long as the changes do not substantially affect their intended function. The functions of one element can be performed by two, and vice versa unless specifically stated otherwise. The structures and functions of one embodiment can be adopted in another embodiment. It is not necessary for all advantages to be present in a particular embodiment at the same time. Thus, the foregoing descriptions of the embodiments according to the present invention are provided for illustration only.

REFERENCE SIGNS LIST

100, 100*a*, 100*b*: Heat Pump System
200: Utilization Side Unit
211: Utilization Side Expansion Mechanism
212: Utilization Side HEX
300, 300*a*: Heat-Source Side Unit
311: Refrigerant Compressor
312: Heat-Source Side HEX
313: Main Expansion Mechanism
314: Refrigerant HEX
315: Liquid Side Stop Valve
316: Gas Side Stop Valve
317: Accumulator
321: High-Pressure Refrigerant Pipe
322: Liquid Refrigerant Pipe
323: Gas Refrigerant Pipe
324: Low-Pressure Refrigerant Pipe
325*b*: Mode Switching Mechanism
331, 331*a*: First Bypass Pipe
332: Second Bypass Pipe
333*b*: Connection Switching Mechanism
341: First Bypass Valve
342: Second Bypass Valve
351: Bypass Sensor (First Bypass Sensor)
351*a*: Second Bypass Sensor
352: Suction Side Sensor
353: Discharge Side Sensor
400 400*b*: Controller
410: Storage Section
420: Information Input Section
430, 430*b*: Operation Section
440: Information Output Section
450, 450*b*: Valve Control Section
451: First Valve Control Section
452: Second Valve Control Section
453: Mode Control Section
454*b*: Connection Control Section

The invention claimed is:

1. A heat pump system, comprising:

a refrigerant compressor;

a high-pressure refrigerant pipe connected with a discharge port of the refrigerant compressor;

a low-pressure refrigerant pipe connected with a suction port of the refrigerant compressor;

a heat-source side heat exchanger connected to either one of the high-pressure refrigerant pipe and the low-pressure refrigerant pipe, and configured to cause a heat-exchange between refrigerant flowing therein and fluid passing therethrough;

a liquid refrigerant pipe connected with the heat-source side heat exchanger, and configured to be connected to a utilization side heat exchanger which is configured to cause a heat-exchange between refrigerant flowing therein and fluid passing therethrough;

a gas refrigerant pipe connected to another one of the high-pressure refrigerant pipe and the low-pressure refrigerant pipe, and configured to be connected to the utilization side heat exchanger;

a main expansion mechanism disposed in the liquid refrigerant pipe;

a first bypass pipe connected with the liquid refrigerant pipe at a point between the main expansion mechanism and the refrigerant heat exchanger, and connected with the low-pressure refrigerant pipe or an injection port of the compressor;

a refrigerant heat exchanger configured to cause a heat-exchange between refrigerant flowing in the liquid refrigerant pipe and refrigerant flowing in first bypass pipe;

a first bypass valve disposed in the first bypass pipe at a point between the liquid refrigerant pipe and the refrigerant heat exchanger;

a second bypass pipe connected with the liquid refrigerant pipe at a point between the main expansion mechanism and the utilization side heat exchanger, and connected with the low-pressure refrigerant pipe;

a second bypass valve disposed in the second bypass pipe;

a superheated temperature detector configured to detect parameters indicating superheated temperature of refrigerant flowing in the first bypass pipe;

a discharge side sensor configured to detect, as discharge temperature, temperature of refrigerant flowing in the high-pressure refrigerant pipe between the refrigerant compressor and the either one of the heat-source side heat exchanger and the utilization side heat exchanger; and a controller configured to control opening degree of the first bypass valve based on the superheated temperature indicated by the detected parameters and discharge temperature, and control opening degree of the second bypass valve based on the discharge temperature.

2. The heat pump system according to claim 1, wherein:

the first bypass pipe is connected with the low-pressure refrigerant pipe; and the superheated temperature detector includes a bypass sensor configured to detect temperature of refrigerant flowing in the first bypass pipe on a downstream side of the refrigerant heat exchanger, and a suction-side sensor configured to detect pressure of refrigerant flowing in the low-pressure refrigerant pipe.

3. The heat pump system according to claim 1, wherein:

the first bypass pipe is connected with the injection port of the compressor; and the superheated temperature detector includes a first bypass sensor configured to detect temperature of refrigerant flowing in the first bypass pipe on a downstream side of the refrigerant heat exchanger, and a second bypass sensor configured to detect temperature of refrigerant flowing in the first bypass pipe between the first bypass valve and the refrigerant heat exchanger, or a first bypass sensor configured to detect temperature of refrigerant flowing in the first bypass pipe on a downstream side of the refrigerant heat exchanger, and a second bypass sensor configured to detect pressure of refrigerant flowing in the first bypass pipe on a downstream side of the first bypass valve.

4. The heat pump system according to claim 2, further comprising:

an accumulator disposed in the low-pressure refrigerant pipe, wherein:

the first bypass pipe is connected with the low-pressure refrigerant pipe at a point between the accumulator and either one of the heat-source side heat exchanger and the utilization side heat exchanger which is connected with the low-pressure refrigerant pipe; and the second bypass pipe is connected with the low-pressure refrigerant pipe at a point between the accumulator and the refrigerant compressor.

5. The heat pump system according to claim 3, further comprising:

an accumulator disposed in the low-pressure refrigerant pipe, wherein the second bypass pipe is connected with the low-pressure refrigerant pipe at a point between the accumulator and the refrigerant compressor.

6. The heat pump system according to claim 1, wherein the controller is configured to increase the opening degree of the first bypass valve at least when the opening degree of the second bypass valve has reached a first opening degree threshold.

7. The heat pump system according to claim 1, wherein the controller is configured to increase the opening degree of the first bypass valve at least when the discharge temperature has reached a discharge temperature threshold.

8. The heat pump system according to claim 1, wherein the controller is configured to control the opening degree of the first bypass valve such that:

the superheat temperature approaches a target superheat temperature when the discharge temperature is lower than or equal to a first target discharge temperature; and the discharge temperature approaches the first target discharge temperature when the discharge temperature is higher than the first target discharge temperature.

9. The heat pump system according to claim 8, wherein the controller is configured to decrease the value of the first target discharge temperature when the opening degree of the second bypass valve has reached a first opening degree threshold.

10. The heat pump system according to claim 9, wherein the controller is configured to increase the value of the first target discharge temperature when the opening degree of the second bypass valve has decreased to a second opening degree threshold which is lower than or equal to the first opening degree threshold.

11. The heat pump system according to claim 1, wherein the controller is configured to control the opening degree of the first bypass valve such that:

the superheat temperature approaches a target superheat temperature when the opening degree of the second bypass valve is lower than a first opening degree threshold; and the discharge temperature approaches a first target discharge temperature when the opening degree of the second bypass valve is higher than the first opening degree threshold.

12. The heat pump system according to claim 8, wherein the controller is configured to switch from a first control in which the opening degree of the first bypass valve is controlled such that the discharge temperature approaches the first target discharge temperature to a second control in which the opening degree of the first bypass valve is controlled such that the superheat temperature approaches the target superheat temperature when:

the discharge temperature has decreased to a second target discharge temperature which is lower than or equal to the first target discharge temperature; and/or the opening degree of the second bypass valve has decreased to a second opening degree threshold which is lower than or equal to the first opening degree threshold.

13. The heat pump system according to claim 1, wherein the heat pump system is configured to use R32 refrigerant.

14. The heat pump system according to claim 1, further comprising:

a mode switching mechanism configured to switch the state of the heat pump system between a cooling operation mode in which the heat-source side heat exchanger is connected to the high-pressure refrigerant pipe and the gas refrigerant pipe is connected to the low-pressure refrigerant pipe, and a heating operation mode in which the heat-source side heat exchanger is connected to the low-pressure refrigerant pipe and the gas refrigerant pipe is connected to the high-pressure refrigerant pipe; and a connection switching mechanism configured to switch the state of the second bypass pipe between a first connection mode in which the second bypass pipe is connected with the liquid refrigerant pipe at a point between the refrigerant heat exchanger and the utilization side heat exchanger, and a second connection mode in which the second bypass pipe is connected with the liquid refrigerant pipe at a point between the main expansion mechanism and the refrigerant heat exchanger, wherein the controller is further configured to control the connection switching mechanism such that the second bypass pipe is in the first connection mode when the heat pump system is in the cooling operation mode, and the second bypass pipe is in the second connection mode when the heat pump system is in the heating operation mode.

15. A method for controlling the heat pump system according to claim 1, comprising:

controlling the opening degree of the first bypass valve such that the superheat temperature approaches a target superheat temperature when the discharge temperature is lower than or equal to a first target discharge temperature, and such that the discharge temperature approaches the first target discharge temperature when the discharge temperature is higher than the first target discharge temperature; and decreasing the value of the first target discharge temperature when the opening degree of the second bypass valve has reached the first opening degree threshold.

16. The heat pump system according to claim 2, wherein the controller is configured to increase the opening degree of the first bypass valve at least when the opening degree of the second bypass valve has reached a first opening degree threshold.

17. The heat pump system according to claim 3, wherein the controller is configured to increase the opening degree of the first bypass valve at least when the opening degree of the second bypass valve has reached a first opening degree threshold.

18. The heat pump system according to claim 4, wherein the controller is configured to increase the opening degree of the first bypass valve at least when the opening degree of the second bypass valve has reached a first opening degree threshold.

19. The heat pump system according to claim 5, wherein the controller is configured to increase the opening degree of the first bypass valve at least when the opening degree of the second bypass valve has reached a first opening degree threshold.

20. The heat pump system according to claim 2, wherein the controller is configured to increase the opening degree of the first bypass valve at least when the discharge temperature has reached a discharge temperature threshold.

* * * * *